US007004020B2

(12) United States Patent
Schrenkel et al.

(10) Patent No.: US 7,004,020 B2
(45) Date of Patent: Feb. 28, 2006

(54) PRODUCTION PROFILE DETERMINATION AND MODIFICATION SYSTEM

(75) Inventors: Peter J. Schrenkel, Carrollton, TX (US); Terry E. Hix, Blanchard, OK (US); Arthur M. Bedgood, Tyler, TX (US); Christopher Patrick Brown, Flower Mound, TX (US); Albert G. Ollre IV, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/908,757

(22) Filed: May 25, 2005

(65) Prior Publication Data

US 2005/0199394 A1 Sep. 15, 2005

Related U.S. Application Data

(62) Division of application No. 10/025,410, filed on Dec. 19, 2001, now Pat. No. 6,904,797.

(51) Int. Cl.
*E21B 47/10* (2006.01)

(52) U.S. Cl. ..... 73/152.18

(58) Field of Classification Search ..... 73/152.18, 73/152.34; 166/117.6, 187, 277, 278, 292, 166/380, 381, 387; 175/328, 318
See application file for complete search history.

(56) References Cited

U.S. PATENT DOCUMENTS 3,103,812 A * 9/1963 Bourne, Jr. et al. ..... 73/152.42
4,505,341 A * 3/1985 Moody et al. ..... 175/65
4,685,516 A * 8/1987 Smith et al. ..... 166/65.1
4,928,759 A * 5/1990 Siegfried et al. ..... 166/65.1
5,095,983 A * 3/1992 Magnani ..... 166/250.01
5,392,856 A * 2/1995 Broussard et al. ..... 166/285
5,631,413 A * 5/1997 Young et al. ..... 73/152.29
5,704,393 A * 1/1998 Connell et al. ..... 137/614.21
5,762,142 A * 6/1998 Connell et al. ..... 166/325
5,794,703 A * 8/1998 Newman et al. ..... 166/381
5,845,711 A * 12/1998 Connell et al. ..... 166/384
6,082,461 A * 7/2000 Newman et al. ..... 166/381
6,089,323 A * 7/2000 Newman et al. ..... 166/381
6,098,017 A * 8/2000 Brown et al. ..... 702/1
RE37,867 E * 10/2002 Gondouin ..... 166/380
6,585,041 B1 * 7/2003 Crossley ..... 166/53

* cited by examiner

*Primary Examiner*—Hezron Williams
*Assistant Examiner*—Rodney Frank
(74) *Attorney, Agent, or Firm*—Robert Van Someren; Bryan P. Galloway; Jaime A. Castano

(57) ABSTRACT

A system and method for profiling and modifying fluid flow through a wellbore. The system comprises a logging system, a downhole unit, and a deployment system. The logging system comprises a logging tool. The downhole unit is operable to house the logging tool. In addition, the downhole unit is operable to selectively secure a retrievable fluid barrier within a wellbore casing. The deployment system is operable to deploy the downhole unit in the wellbore casing. The method comprises deploying the downhole unit into the wellbore and securing the retrievable fluid barrier below a first group of perforations. The method also comprises operating the logging tool to detect a wellbore fluid parameter.

13 Claims, 6 Drawing Sheets

PRODUCTION PROFILE DETERMINATION AND MODIFICATION SYSTEM

DESCRIPTION

This application is a divisional of U.S. Ser. No. 10/025,410, filed Dec. 19, 2001 now U.S. Pat. No. 6,904,797.

FIELD OF THE INVENTION

The present invention relates generally to the production of fluids from a well, and particularly to a system and method for identifying oil, water, and gas bearing strata in a well and modifying the well to enhance the production of desired fluids from the well.

BACKGROUND OF THE INVENTION

A typical production well has a metal lining, or casing, that extends through the well. A series of perforations are made at specific depths in the casing. The perforations enable fluids in the strata surrounding the perforations to flow into the casing, while preventing fluids at other depths from flowing into the casing. The fluids are then removed from the well through the interior of the casing, either by the pressure of the fluid in the formation or by artificially lifting the fluid to a collection location.

A typical oil or gas production well may pass through many different formations, or strata. The various strata may contain oil, gas, water, or combinations thereof. Preferably, the perforations in the casing are made at depths that correspond to strata bearing a desired production fluid, such as oil and/or natural gas, and minimal amounts, if any, of water. However, the fluid flowing into the interior of the casing may contain portions of oil, gas, and water. Additionally, the proportions of oil, gas, and/or water that enter through the perforations from the surrounding strata may vary according to depth.

Consequently, some wells are profiled to identify the proportions of water, oil, and gas flowing into the casing at various depths. An iterative process of plugging and logging the well is used to form the profile of the well. First, a plug is lowered into the well by an insertion device to isolate a portion of the well. The insertion device is then removed from the well and a logging tool is lowered into the well. An artificial lift system, such as a pump, is used to produce a flow of fluid into the casing through a first group of perforations. The logging tool is operable to detect characteristics of the fluid entering the well, such as the proportion of oil, gas, and water flowing into the casing.

To detect the characteristics of the fluid entering the well through a second group of perforations, the logging tool is removed from the well and the insertion device is lowered back into the casing to move the plug to a second location. The logging tool is then lowered back into the well to log the fluid characteristics through the second group of perforations. This process may be repeated for many groups of perforations. By analyzing the data, those groups of perforations that do not produce desired production fluids and/or produce large amounts of water may be isolated using a plug, or other device.

The iterative process described above is time-consuming and labor intensive. A need exists for a system or method that enables a well to be profiled without having to repeatedly remove the logging tool and/or insertion device from the well.

SUMMARY OF THE INVENTION

The present invention features a technique for profiling and modifying fluid flow through a wellbore. According to one aspect of the present technique, a system comprising a logging system, a downhole unit, and a deployment system is featured. The logging system comprises a logging tool. The downhole unit is operable to house the logging tool. In addition, the downhole unit is operable to selectively secure a retrievable fluid barrier within a wellbore casing. The deployment system is operable to deploy the downhole unit in the wellbore casing.

According to another aspect of the present technique, a method for profiling fluid flow through a wellbore is featured. The method comprises deploying a downhole unit into the wellbore. The downhole unit is operable to house a logging tool and to selectively secure a retrievable fluid barrier within a wellbore casing. The method also comprises operating the logging tool to detect a parameter of fluid flow through a first group of perforations in the wellbore casing. The method also may comprise inducing a flow of fluid into the wellbore through the first group of perforations.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Figure 1:
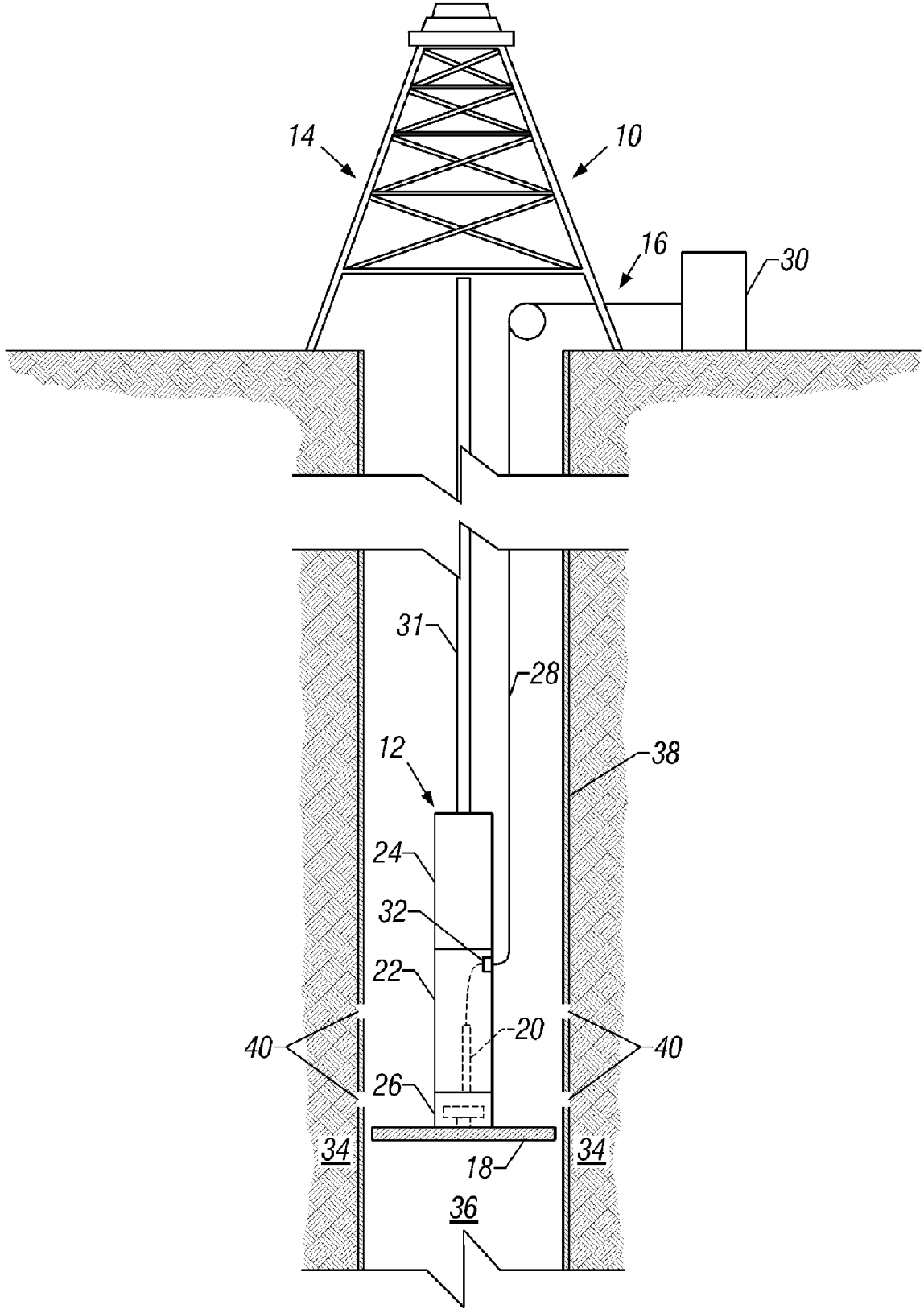
FIG. 1 is a front elevational view of an exemplary application of the present technique, illustrating a production profile determination and modification system deployed in a wellbore.

Referring generally to FIG. 1, a production profile determination and modification system 10 is illustrated in a subterranean environment, according to one embodiment of the present invention. Production profile determination and modification system 10 comprises a deployable unit 12, a deployment system 14, and a logging system 16.

An exemplary deployable unit 12 is a downhole tool comprising a retrievable plug 18, a logging tool 20, a housing 22 for logging tool 20, an artificial lift system 24, and a plug-retrieving device 26. In the illustrated embodiment, plug 18 is a retrievable bridge plug operable to form a barrier to fluid. However, other flow retrievable fluid barriers may be used. Housing 22 may be a downhole lubricator adapted to house logging tool 20. Logging tool 20 may be a permanent component within housing 22 or, alternatively, housing 22 may be adapted to receive a separate logging tool 20. Artificial lift device 24 is operable to induce fluid flow. Artificial lift device 24 may be an electric submersible pump, e.g. ESP. Plug-retrieving device 26 may comprise an overshot secured to the housing and having a passageway (not shown) to enable logging tool 20 to be lowered from housing 22.

Logging system 16 comprises logging tool 20, a wireline 28, and a data acquisition/analysis system 30. Logging tool 20 is operable to provide a stream of data along a line 28, such as a wireline, to data acquisition/analysis system 30. In the exemplary embodiment, logging tool 20 is operable to identify the oil, water and gas bearing strata. Preferably, logging tool 20 is operable to detect a number of downhole fluid flow parameters, such as the rate of fluid flow and the proportions of oil, gas, and water in the fluid flow. For example, logging tool 20 may be a PSP (pseudo-static spontaneous potential) tool. Logging tool 20 may be configured to measure other downhole parameters as well, such as fluid pressure. Data typically is recorded on a "log" that displays information about the formation as a function of depth. The data also may be recorded in digital format for processing later. An exemplary data acquisition/analysis system 30 comprises computer hardware and software.

Deployment system 14 is operable to raise and lower deployable unit 12. Examples of deployment system 14 comprise a derrick, a platform, a winch, or other systems for raising and lowering deployable unit 12 in wellbore 36. In addition, deployment system 14 comprises a coupling member 31 to couple deployable unit 12 to a derrick, platform, etc. In the illustrated embodiment, coupling member 31 comprises a string of production pipe. However, coupling member 31 may comprise coiled tubing, a wireline, or other apparatus coupleable to deployable unit 12 to enable the derrick, platform, winch, etc. to support deployable unit 12. Furthermore, in the illustrated embodiment, deployment system 14 is operable to direct the engagement of retrievable plug 18.

As illustrated in FIG. 1, line 28 enters housing 22 via a side-entry door 32, which may, or may not, be a component of a side-entry sub. However, deployable unit 12 may be adapted for other typos of entry for line 28. In addition, deployable unit 12 and logging tool 20 may be adapted for assembly in the field.

Deployable unit 12 is deployed within a geological formation 34 via a wellbore 36. Typically, wellbore 36 is lined with casing 38 having openings 40, e.g. perforations, through which wellbore fluids enter wellbore 36 from geological formation 34. Alternatively, deployable unit 12 may be deployed in an open-hole wellbore, i.e., a wellbore that is not lined with casing. In the illustrated technique, deployable unit 12 is deployed by deployment system 14 into wellbore 36 so that plug 18 may be set in casing 38 below the lowest perforation 40. Plug-retrieving device 26 is operable to selectively secure plug 18 to deployable unit 12 and to casing 38. Deployable unit 12 may also be positioned to set plug 18 at other locations within casing 38, depending on the information to be gathered.

Figure 2:
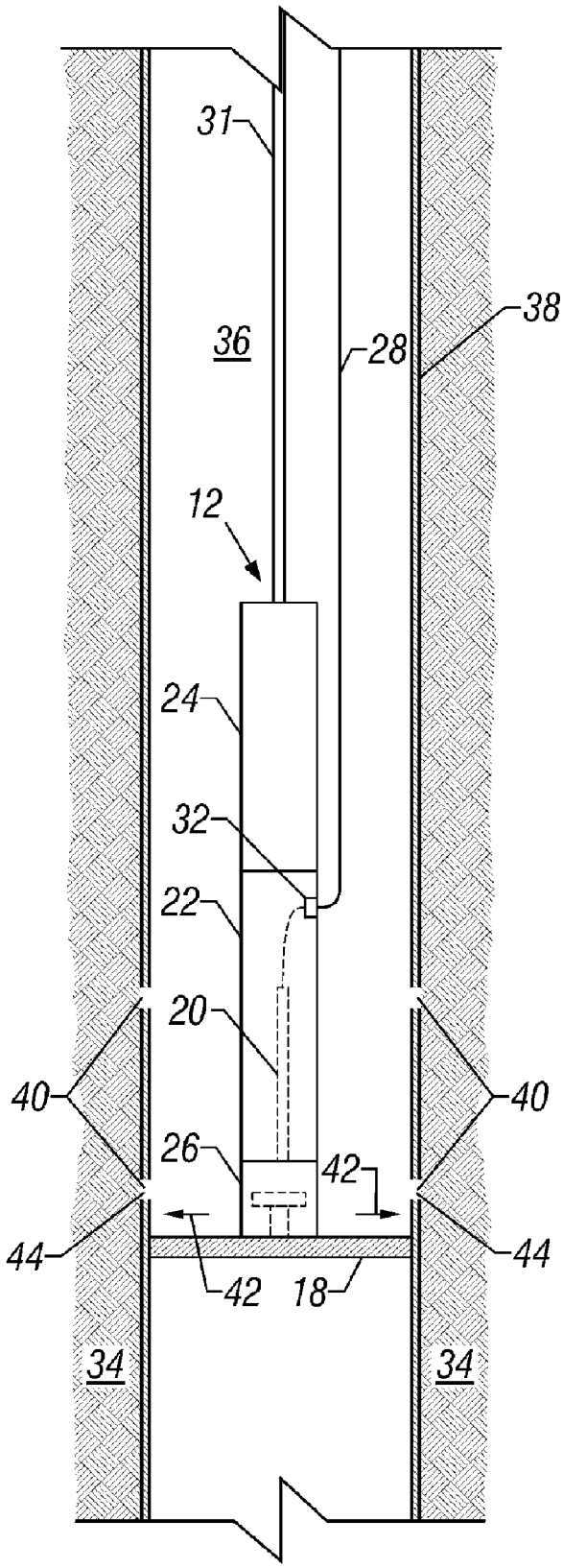
FIG. 2 is a front elevational view of the production profile determination and modification system deploying a retrievable plug in a well casing, according to an exemplary embodiment of the present technique.

Referring generally to FIG. 2, deployable unit 12 and plug-retrieving device 26 are manipulated by deployment system 14 to expand plug 18 into engagement against casing 38 so as to secure plug 18 within casing 38. In FIG. 2, plug 18 has been expanded, as represented by arrows 42, into engagement with casing 38 below a first set 44 of perforations 40.

Figure 3:
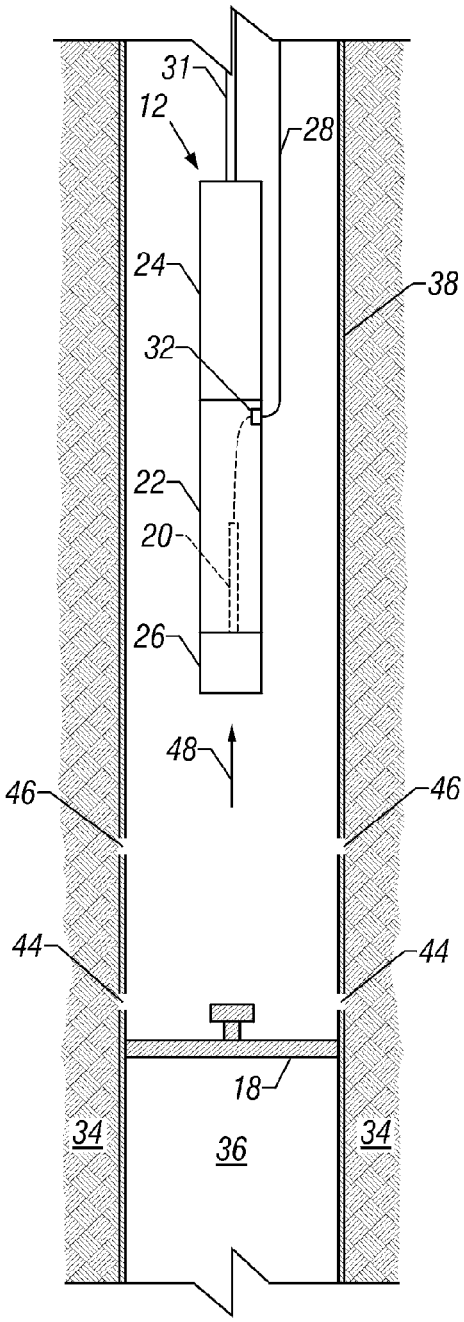
FIG. 3 is a front elevational view of the production profile determination and modification system deployed above the perforations in the wellbore, according to an exemplary embodiment of the present technique.

Referring generally to FIG. 3, deployable unit 12 is raised above a second set 46 of perforations, as represented by the arrow 48, after plug 18 is set below the first set 44 of perforations 40. From this position above the second set 46 of perforations, system 10 is able to establish a baseline profile of fluid flow through both sets of perforations 40.

Figure 4:
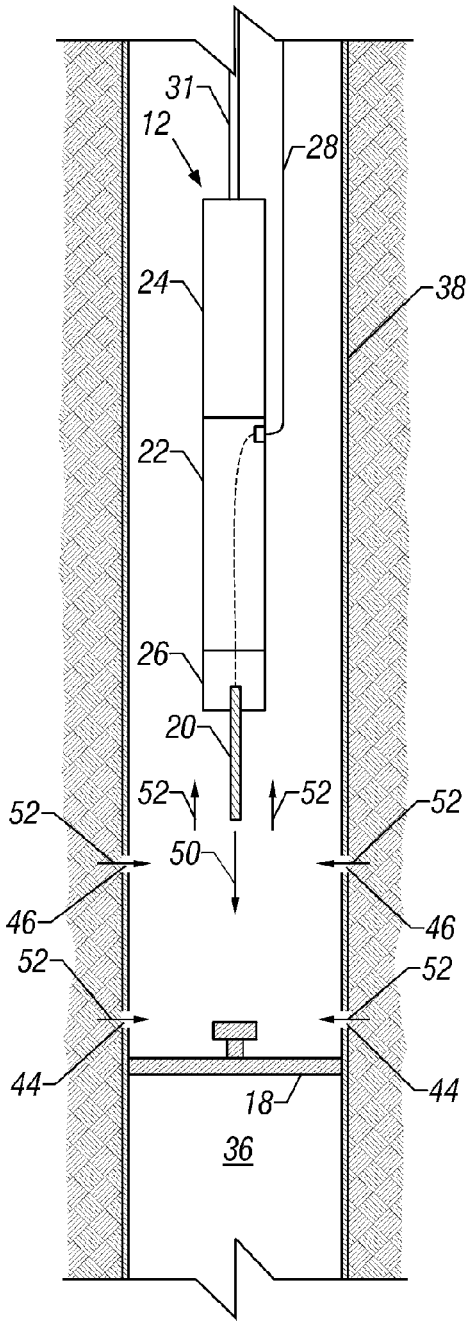
FIG. 4 is a front elevational view of the production profile determination and modification system illustrating the logging tool deployed and the system artificially lifting the fluid in the wellbore, according to an exemplary embodiment of the present technique.

In the exemplary technique, logging tool 20 then is lowered from deployable unit 12 to log downhole fluid characteristics, as represented by arrow 50 in FIG. 4. In the illustrated embodiment, line 28 is used to lower logging tool 20 from housing 22. However, in other embodiments of system 10, other devices, such as a winch system within housing 22, may lower logging tool 20. Alternatively, logging tool 20 may be operated to detect fluid characteristics without lowering logging tool 20 from deployable unit 12.

In the illustrated technique, artificial lift device 24 is operated to produce a flow of fluid 52 through both sets of perforations 40. Logging tool 20 is operated to establish the percentages of oil, water, and gas in fluid 52. Logging tool 20 also may be operable to establish the flow rates of oil, water, and gas in the fluid flow. Furthermore, in some applications, logging tool 20 is used to measure other down-hole fluid characteristics, such as fluid velocity, density, temperature, and pressure. Additionally, logging tool 20 may incorporate other devices, such as a casing collar locator.

Figure 5:
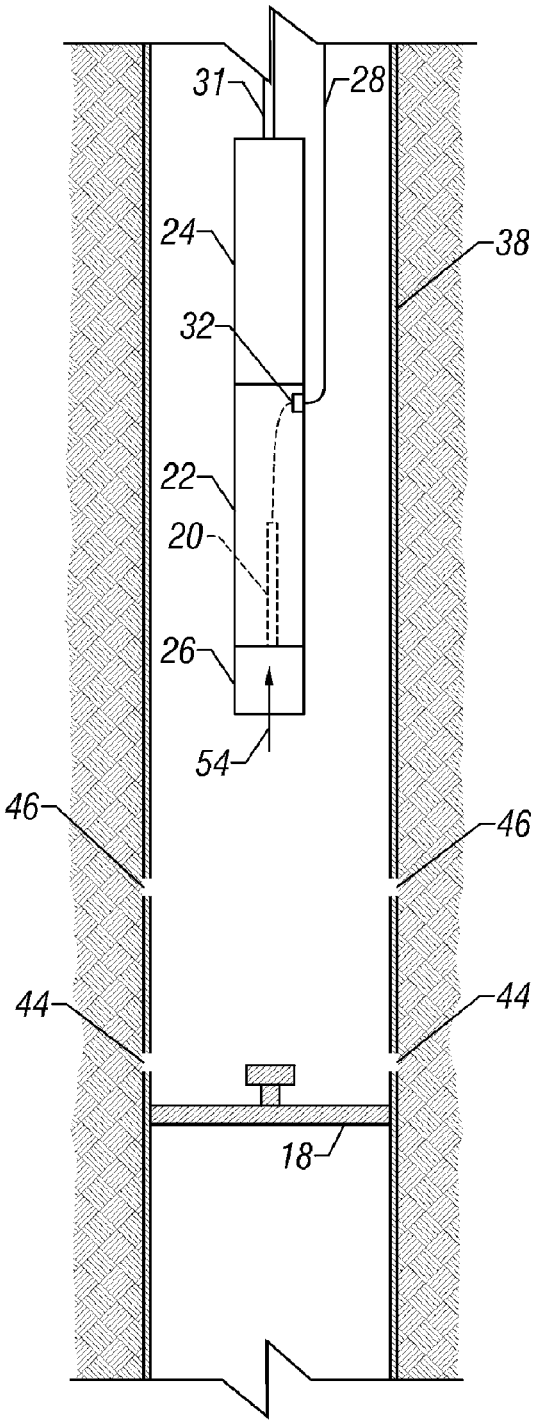
FIG. 5 is a front elevational view of the production profile determination and modification system with the logging tool withdrawn within a housing and the artificial lift secured for re-deployment of the plug, according to an exemplary embodiment of the present technique.
Figure 6:
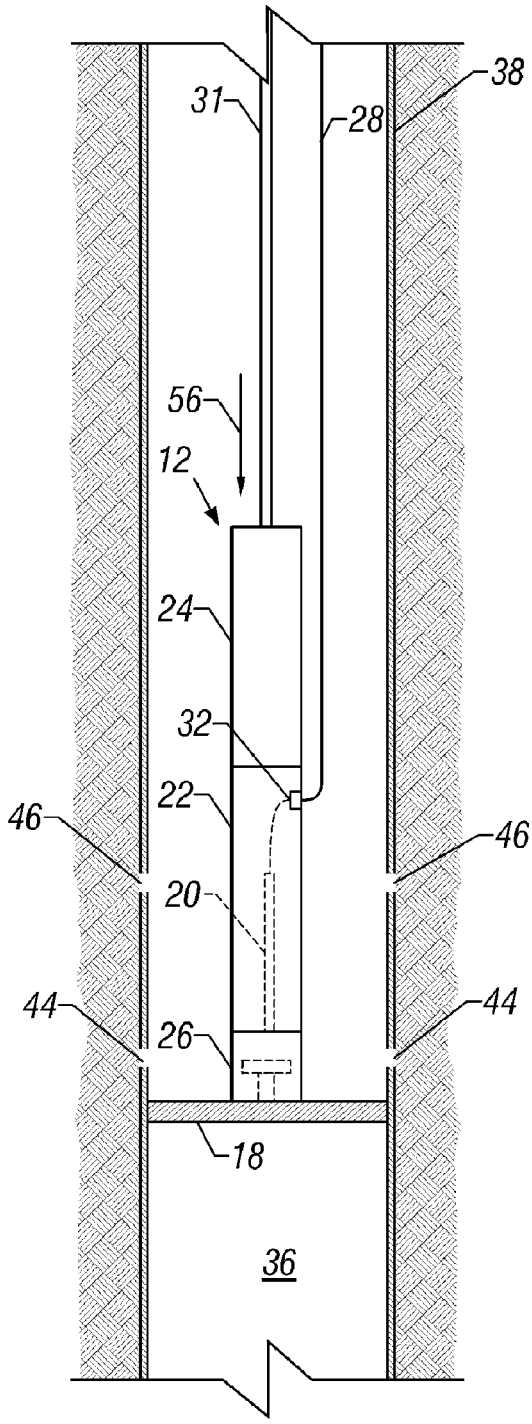
FIG. 6 is a front elevational view of the production profile determination and modification system engaging the plug to retrieve the plug from the casing, according to an exemplary embodiment of the present technique.
Figure 7:
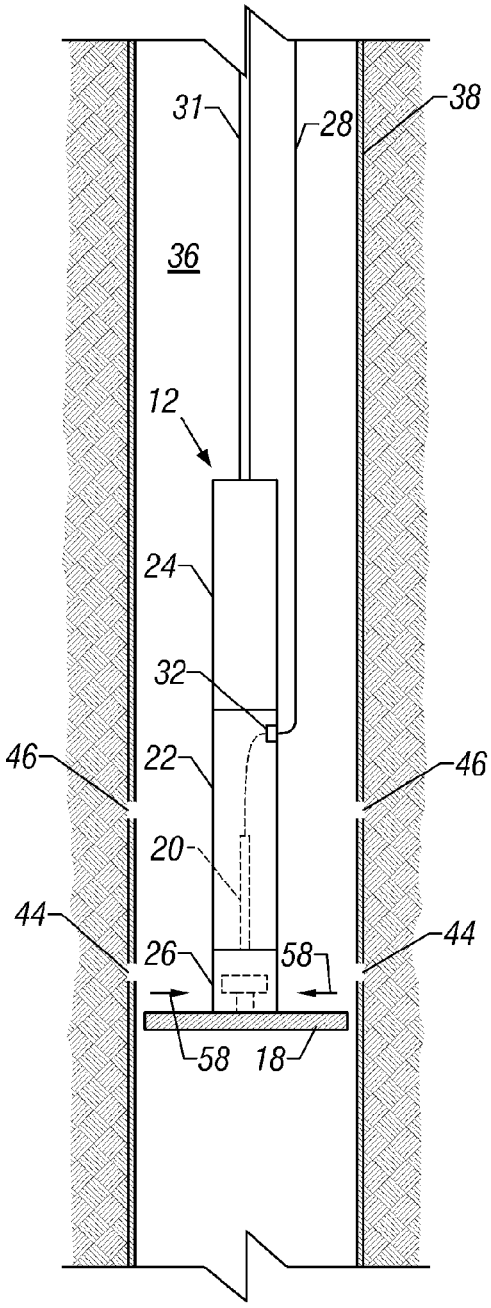
FIG. 7 is a front elevational view of the production profile determination and modification system disengaging the plug from the casing, according to an exemplary embodiment of the present technique.

Subsequent to logging, artificial lift device 24 is deactivated and logging tool 20 is returned to housing 22, as represented by arrow 54 in FIG. 5. Then, deployable unit 12 is lowered to engage plug 18, as represented by arrow 56 in FIG. 6. As illustrated best in FIG. 7, plug-retrieving device 26 is then operated to contract and disengage plug 18 from casing 38, as represented by arrows 58.

Figure 8:
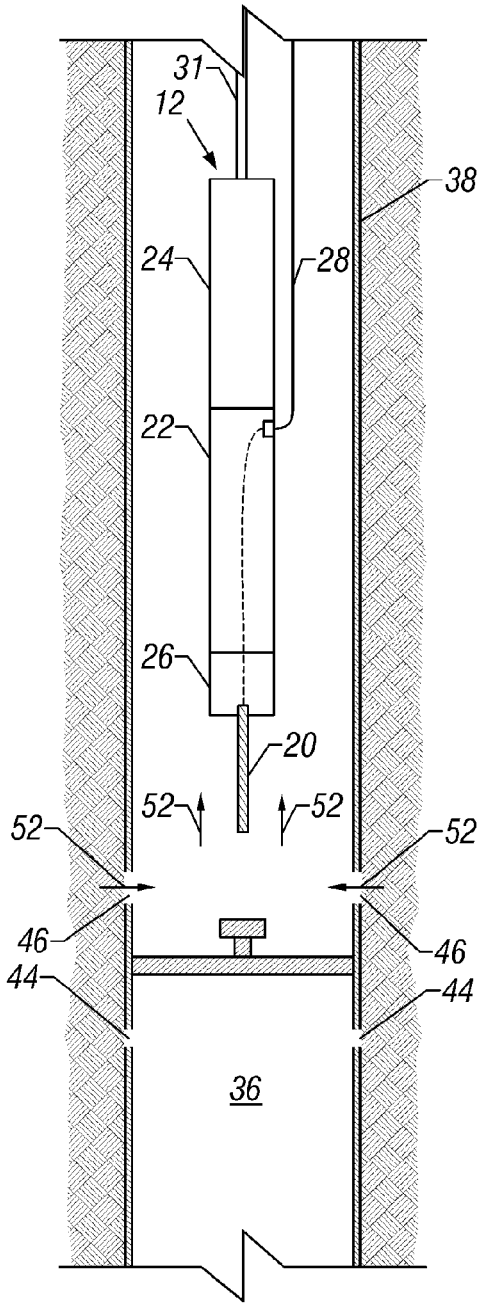
FIG. 8 is a front elevational view of the production profile determination and modification system redeployed between two series of perforations in the wellbore, according to an exemplary embodiment of the present technique.

Referring generally to FIG. 8, system 10 is operated in a similar manner to re-deploy plug 18 in casing 38 above the first set 44 of perforations 40 and below the second set 46 of perforations 40. After securing plug 18 to casing 38, deployable unit 12 is repositioned above the second set 46 of perforations 40. Logging tool 20 is lowered and artificial lift device 24 is operated to produce a flow of fluid through the second set 46 of perforations 40. As described above, with respect to the exemplary embodiment, logging tool 20 is operable to establish the percentages of oil, water, and gas in the flow of fluid 52 through the second set 46 of perforations 40. Additionally, in at least some applications, logging tool 20 is operable to establish other down-hole characteristics to establish the flow rates or other parameters of oil, water, and gas in the fluid flow, as discussed above.

A profile of wellbore 36 may be established by using data acquisition/analysis system 30 to compare the data received from logging tool 20 at the two positions of plug 18 to identify, for example, the oil, water, and gas bearing strata adjacent to the first and second sets of perforations 40. In the illustrated technique, the percentages of oil, gas, and water entering wellbore 28 through each set of perforations may be established by comparing the percentages of oil, gas, and water with fluid flow through both sets of perforations to the percentages of oil, gas, and water through only the second set of perforations. The same comparison can be made for flow through other or additional perforations.

Although only two sets of perforations are illustrated in the Figures, it is understood that the illustrated technique can be used with any number of perforation sets. Plug 18 simply is retrieved and moved as desired to profile the additional sets of perforations.

The profile then may be used to selectively modify fluid flow through casing 38. For example, plug 18 may be left in the position illustrated in FIG. 8 to block-off flow into wellbore 36 from the first set 44 of perforations. This would be desirable, for instance, if the profile indicates that a high percentage of water, or low percentage of desirable production fluids, is entering wellbore 36 via first set of perforations 40. Plug 18 effectively is used to reduce the amount of water brought into wellbore 36 and to increase the percentage of desirable production fluids, such as oil and gas, in the wellbore fluid.

Figure 9:
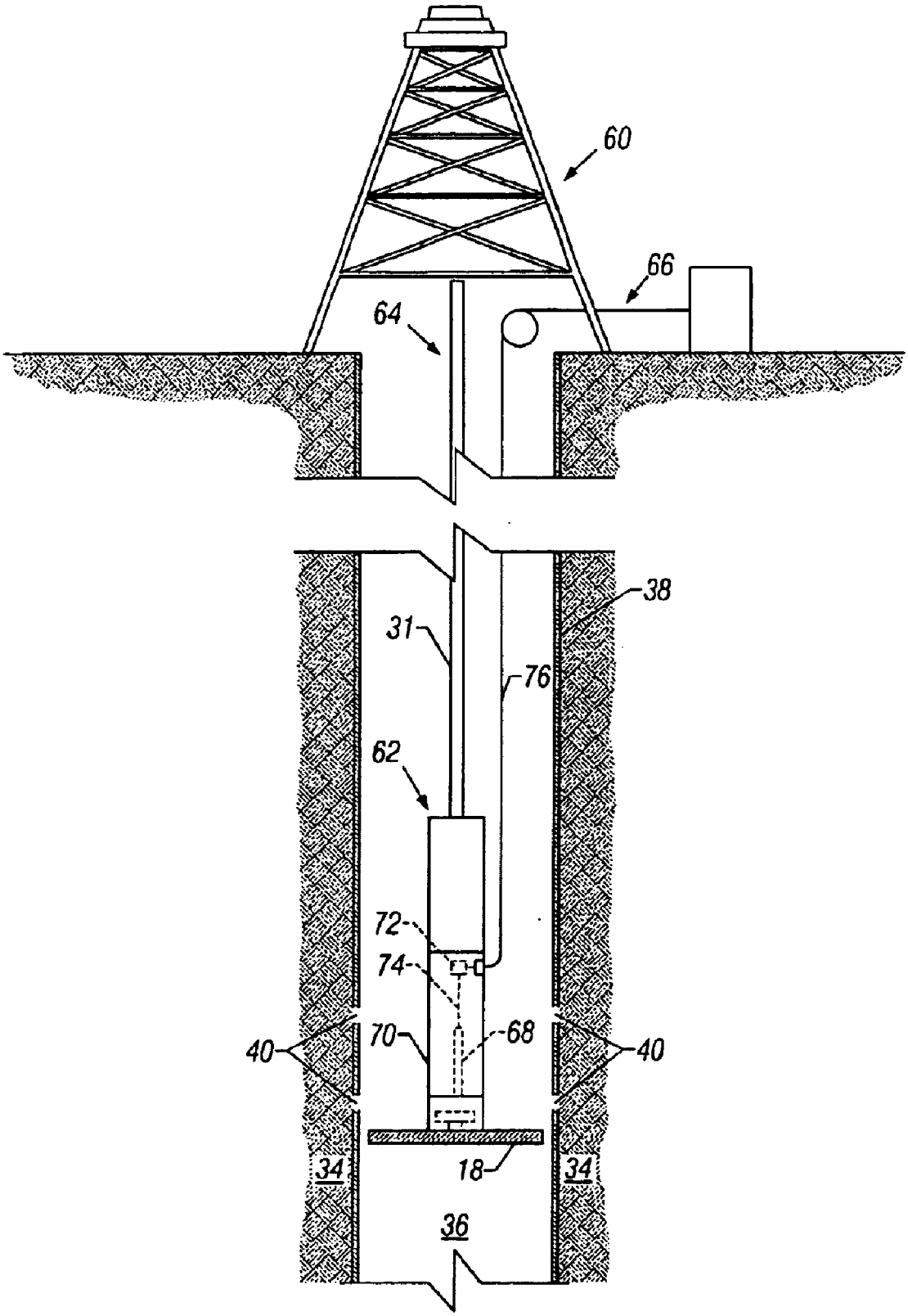
FIG. 9 is a front elevational view of an alternative application of the present technique.

Referring generally to FIG. 9, an alternative embodiment of a production profile determination and modification system 60 is illustrated. The system 60 comprises a deployable unit 62, a deployment system 64, and a logging system 66. In the illustrated embodiment, a logging tool 68 is housed within a housing 70. In this embodiment, the housing 70 supports the logging tool 68. In the illustrated embodiment, the logging tool 68 is supported from a winch 72 by a line 74. However, other methods of deploying the logging tool 68 from housing 70 may be used. Additionally, logging system 66 comprises a cable 76 to electrically couple the logging tool 68 to a data acquisition/analysis system 30. The line 74 may be used to electrically couple the logging tool 68 to the cable 76, as well as support the logging tool 68. Alternatively, a separate cable may be used.

Overall, it should be understood that the foregoing description is of exemplary embodiments of this invention, and that the invention is not limited to the specific forms shown. For example, a fluid barrier other than a retrievable bridge plug may be used. In addition, the logging tool type may vary, as well as the parameters detected by the logging tool. Furthermore, the logging tool may be a separate device inserted into the housing or a combined unit with the housing. These and other modifications may be made in the design and arrangement of the elements without departing from the scope of the invention as expressed in the appended claims.

What is claimed is:

1. A method of profiling and modifying fluid flow within a wellbore, comprising:

deploying a tool string into a wellbore lined with a casing, the tool string having a retrievable fluid barrier, a logging tool and a downhole tool;

actuating the downhole tool to secure the fluid barrier within the casing below a first group of perforations in the casing;

disengaging the downhole tool from the fluid barrier;

operating the logging tool to detect characteristics of the fluid flowing into the wellbore through the first group of perforations.

2. The method as recited in claim 1, further comprising:

releasing the fluid barrier; and moving the fluid barrier to another location within the casing.

3. The method as recited in claim 1, wherein operating comprises lowering at least a portion of the logging tool below the downhole tool.

4. The method as recited in claim 1, comprising obtaining a flow of fluid into the wellbore via the first group of perforations.

5. The method as recited in claim 4, wherein deploying comprises securing an artificial lift device to the tool string.

6. The method as recited in claim 5, wherein obtaining comprises operating the artificial lift device to cause the flow of fluid.

7. The method as recited in claim 1, wherein operating comprises operating the logging device to identify percentages of oil and water in the flow of fluid.

8. The method as recited in claim 1, further comprising raising the tool string above the first group of perforations in the casing after securing the fluid barrier within the casing below the first group of perforations in the casing.

9. The method as recited in claim 1, further comprising retrieving the fluid barrier with the tool string.

10. The method as recited in claim 1, further comprising:

repositioning the tool string in the casing;

securing the fluid barrier within the casing below a second group of perforations in the casing; and operating the logging tool to detect characteristics of the fluid flowing into the wellbore via the second group of perforations.

11. The method as recited in claim 10, further comprising analyzing the characteristics of the fluid flowing into the wellbore through the first and second group of perforations to identify which group of perforations produces a more desirable fluid flow.

12. The method as recited in claim 11, further comprising securing the fluid barrier within the casing to isolate fluid flow through the casing via the group of perforations that produces the more desirable fluid flow.

13. The method as recited in claim 12, wherein deploying a tool string into a wellbore lined with the casing; analyzing the characteristics of the fluid; and securing the fluid barrier to isolate fluid flow are performed during a single trip of the tool string into the wellbore.

* * * * *